US010186775B2

(12) United States Patent
Bocskor et al.

(10) Patent No.: US 10,186,775 B2
(45) Date of Patent: Jan. 22, 2019

(54) PATCH ANTENNA ELEMENT WITH PARASITIC FEED PROBE

(71) Applicant: The United States of America, as represented by the Secretary of the Army, Washington, DC (US)

(72) Inventors: Timothy Bocskor, Baltimore, MD (US); Shuguang Chen, Ellicott City, MD (US); Mahmoud Khalil, Lincroft, NJ (US)

(73) Assignee: The United States of America, as represented by the Secretary of the Army, Washington, DC (US)

( * ) Notice: Subject to any disclaimer, the term of this patent is extended or adjusted under 35 U.S.C. 154(b) by 671 days.

(21) Appl. No.: 14/823,305

(22) Filed: Aug. 11, 2015

(65) Prior Publication Data

US 2017/0047656 A1 Feb. 16, 2017

(51) Int. Cl.
*H01Q 9/04* (2006.01)

(52) U.S. Cl.
CPC ..... *H01Q 9/0407* (2013.01)

(58) Field of Classification Search
CPC ..... H01Q 9/0407
See application file for complete search history.

(56) References Cited

U.S. PATENT DOCUMENTS 6,091,373 A * 7/2000 Raguenet ..... H01Q 9/0414 333/137
7,489,280 B2 * 2/2009 Aminzadeh ..... H01Q 1/3275 343/700 MS
8,063,832 B1 11/2011 Weller et al.
8,159,409 B2 4/2012 Harokopus et al.
8,522,421 B2 9/2013 Chen et al.
8,599,072 B2 12/2013 Reed et al.
8,860,613 B2 10/2014 Andrenko
8,952,851 B1 2/2015 Hsu et al.
8,963,793 B2 2/2015 Saliga et al.
2004/0090370 A1 * 5/2004 McCarrick ..... H01Q 9/0414 343/700 MS
2005/0110685 A1 * 5/2005 Frederik du Toit ..... H01Q 9/0414 343/700 MS
2007/0126638 A1 * 6/2007 Channabasappa ... H01Q 9/0407 343/700 MS
2010/0194643 A1 * 8/2010 Petros ..... H01Q 9/0457 343/700 MS
2011/0209338 A1 9/2011 Chen et al.
2011/0260928 A1 10/2011 Ito et al.
2012/0229364 A1 9/2012 Nakabayashi et al.
2012/0280888 A1 11/2012 Thiam et al.
2012/0287002 A1 11/2012 Parsche
2012/0287017 A1 11/2012 Parsche
(Continued)

*Primary Examiner* — Dameon E Levi
*Assistant Examiner* — David Lotter
(74) *Attorney, Agent, or Firm* — Ronald Krosky; Azza Jayaprakash

(57) ABSTRACT

Various embodiments are described that relate to a patch antenna. Portions of a patch antenna, such as a patch antenna element and a probe feed wire can produce an impedance that is undesirable. To compensate for this, a parasitic feed pad can be aligned with the patch antenna element to create a capacitor. This capacitor produces a capacitance that negates the impedance. It can be preferred for the capacitance to be such that there is no excess capacitance and no excess impedance.

20 Claims, 11 Drawing Sheets

(56) References Cited

U.S. PATENT DOCUMENTS

| | | | | |
|---|---|---|---|---|
| 2012/0287018 | A1 | 11/2012 | Parsche | |
| 2013/0082879 | A1 | 4/2013 | Fuchs et al. | |
| 2013/0147682 | A1 | 6/2013 | Schadler | |
| 2013/0180967 | A1 | 7/2013 | Teng et al. | |
| 2013/0265203 | A1 | 10/2013 | Ermutlu et al. | |
| 2013/0271344 | A1 | 10/2013 | Tasaki et al. | |
| 2014/0198014 | A1 | 7/2014 | Fasenfest | |
| 2015/0194734 | A1 | 7/2015 | Chiu | |
| 2015/0194999 | A1 | 7/2015 | Lea et al. | |
| 2017/0018848 | A1* | 1/2017 | Boutayeb | H01Q 3/34 |
| 2018/0034147 | A1* | 2/2018 | Hashimoto | H01Q 1/48 |

* cited by examiner

PATCH ANTENNA ELEMENT WITH PARASITIC FEED PROBE

GOVERNMENT INTEREST

The innovation described herein may be manufactured, used, imported, sold, and licensed by or for the Government of the United States of America without the payment of any royalty thereon or therefor.

BACKGROUND

Communication systems can employ antennas to send information between two locations. These antennas can have preferred operating characteristics. When functioning at preferred operating characteristics, communication can be clearer and processing of data can be faster. Therefore, it can be desirable to have antennas perform with preferred operating characteristics.

SUMMARY

In one embodiment, a system comprises a patch antenna element and a parasitic feed pad. The patch antenna element and the parasitic feed pad are parallel to one another, are stacked together, and do not touch. The patch antenna element produces an impedance and the patch antenna element and the parasitic feed pad together produce a capacitance that compensates for the impedance.

In one embodiment, a system comprises a patch antenna element, a parasitic feed pad, and a probe feed wire. The probe feed wire can emit an electromagnetic field to excite the patch antenna element such that the patch antenna element is operational can be configured to not touch the patch antenna element. The patch antenna element and the parasitic feed pad can be parallel to one another, be stacked together, not touch one another, and together produces an impedance. The patch antenna element and the parasitic feed pad together produce a capacitance in series with the impedance such that a sum of the impedance with the capacitance is equal to about zero.

A patch antenna production system comprising a configuration component and an output component. The configuration component can be configured to determine a parameter set for a patch antenna and the output component can be configured to cause an output of the parameter set. The patch antenna comprises a patch antenna element, a parasitic feed wire, and a parasitic feed pad. The probe feed wire does not touch the patch antenna element. The patch antenna element and the parasitic feed pad are parallel to one another, are stacked together, do not touch, and together produces an impedance. The patch antenna element and the parasitic feed pad together produce a capacitance in series with the impedance such that a sum of the impedance with the capacitance is equal to about zero.

BRIEF DESCRIPTION OF THE DRAWINGS

Incorporated herein are drawings that constitute a part of the specification and illustrate embodiments of the detailed description. The detailed description will now be described further with reference to the accompanying drawings as follows.

DETAILED DESCRIPTION

Figure 1A:
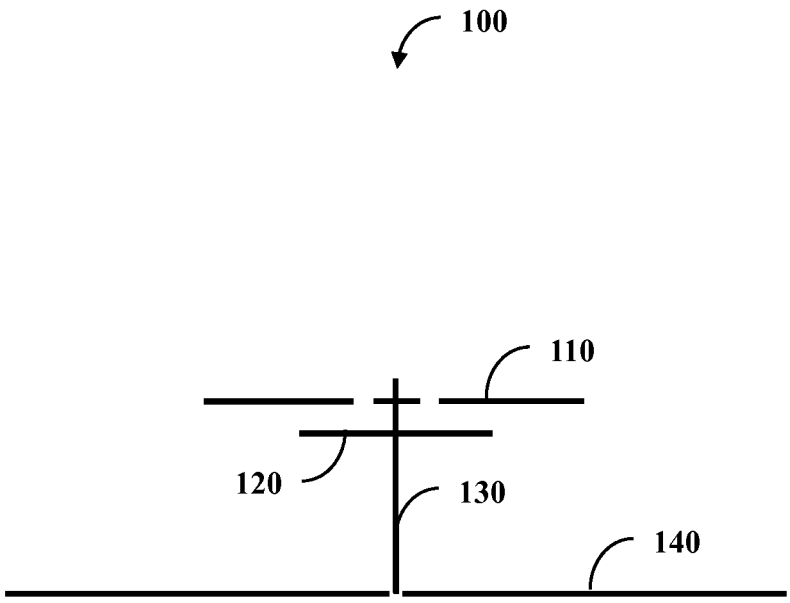
FIGS. 1*a* and 1*b* illustrate one embodiment of a system comprising a patch antenna element, a parasitic feed pad, a probe feed wire, and a ground plane.

In one embodiment, aspects disclosed herein relate to a patch antenna. The patch antenna can comprise a patch antenna element that, when excited, performs communication functions and a probe feed wire that causes the excitement. The patch antenna can have a resistance, such as 50Ω, that is desired and this resistance can be considered a real part of the patch antenna complex input impedance. It may be desirable for patch antenna to not have an imaginary part (this can allow the antenna to have a maximum radio frequency signal that is radiated from a signal source). However, a feed probe of the patch antenna element and/or the probe feed wire can individually introduce extra inductance into the patch antenna that contribute to the imaginary part.

To counter this, an element that introduces capacitance into the patch antenna can be used. Since the patch antenna comprises the patch antenna element the patch antenna element can be leveraged to produce the capacitance. A parasitic feed patch can be aligned parallel with the patch antenna element. Together, the parasitic feed patch and the patch antenna element can form a capacitor. The configuration of the parasitic feed patch, such as size and shape, can be such that the imaginary part of the input impedance is cancelled. Therefore, the imaginary part can be a net of about zero. With this, impedance mismatching and return loss in current of the patch antenna can be compensated without lumped elements.

The following includes definitions of selected terms employed herein. The definitions include various examples. The examples are not intended to be limiting.

"One embodiment", "an embodiment", "one example", "an example", and so on, indicate that the embodiment(s) or example(s) can include a particular feature, structure, characteristic, property, or element, but that not every embodiment or example necessarily includes that particular feature, structure, characteristic, property or element. Furthermore, repeated use of the phrase "in one embodiment" may or may not refer to the same embodiment.

"Computer-readable medium", as used herein, refers to a medium that stores signals, instructions and/or data. Examples of a computer-readable medium include, but are not limited to, non-volatile media and volatile media. Non-volatile media may include, for example, optical disks, magnetic disks, and so on. Volatile media may include, for example, semiconductor memories, dynamic memory, and so on. Common forms of a computer-readable medium may include, but are not limited to, a floppy disk, a flexible disk, a hard disk, a magnetic tape, other magnetic medium, other optical medium, a Random Access Memory (RAM), a Read-Only Memory (ROM), a memory chip or card, a memory stick, and other media from which a computer, a processor or other electronic device can read. In one embodiment, the computer-readable medium is a non-transitory computer-readable medium.

"Component", as used herein, includes but is not limited to hardware, firmware, software stored on a computer-readable medium or in execution on a machine, and/or combinations of each to perform a function(s) or an action(s), and/or to cause a function or action from another component, method, and/or system. Component may include a software controlled microprocessor, a discrete component, an analog circuit, a digital circuit, a programmed logic device, a memory device containing instructions, and so on. Where multiple components are described, it may be possible to incorporate the multiple components into one physical component or conversely, where a single component is described, it may be possible to distribute that single component between multiple components.

"Software", as used herein, includes but is not limited to, one or more executable instructions stored on a computer-readable medium that cause a computer, processor, or other electronic device to perform functions, actions and/or behave in a desired manner. The instructions may be embodied in various forms including routines, algorithms, modules, methods, threads, and/or programs including separate applications or code from dynamically linked libraries.

Figure 1B:
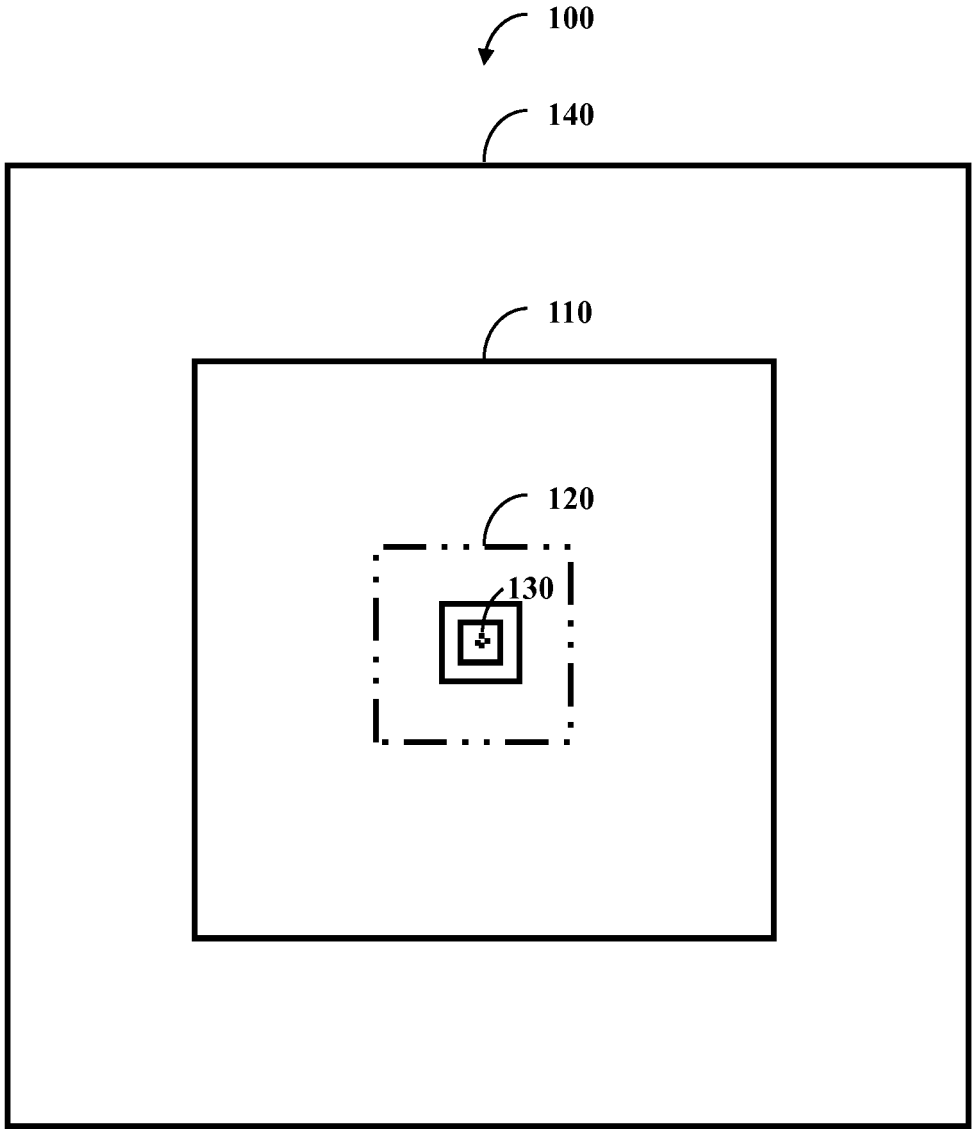

FIGS. 1*a* and 1*b* illustrate one embodiment of a system 100 comprising a patch antenna element 110, a parasitic feed pad 120, a probe feed wire 130, and a ground plane 140. FIG. 1*a* illustrates a side view of the system 100 while FIG. 1*b* illustrates a top-down view of the system 100. In the top-down view, the parasitic feed pad 120 would not be visible when its profile is smaller than a profile of the patch antenna element 110. Therefore, the parasitic feed pad 120 and the probe feed wire 130 are illustrated with a broken line to show how it can fit under the patch antenna element 110.

The parasitic antenna element 110 and the parasitic feed pad 120 can be configured to function as a system absent the probe feed wire 130 (also known as a parasitic feed probe or a parasitic probe feed) and/or the ground plane 140. In one embodiment, a small area can exist on the same level as the antenna element 110. This area can be isolated from the antenna element 110, by way of small gap between the area and the antenna element 110. This small area can function to excite the antenna element 110 can be of a square shape, rectangular shape, circle shape, or other shape.

The patch antenna element 110 and the parasitic feed pad 120 and/or the ground plane 140 can be parallel to one another and stacked together. This stacking can be such that the patch antenna element 110 and the parasitic feed pad 120 and/or ground plane 140 do not touch. In one example, air can separate the patch antenna element 110 from the parasitic feed pad 120 and/or the ground plane 140.

When the system 100 is operational, the patch antenna element 110 can produce a reactance (by way of inductance). It may be desirable for a sum of the impedance and capacitance of the system 100 to be equal to about zero. In view of this, the patch antenna element 110 and the parasitic feed pad 120 can together produce a capacitance that compensates for the impedance of the patch antenna element 110. To perform this compensation, the patch antenna element 110 and the parasitic feed pad 120 can form a capacitor. This compensation can completely compensate such that a total series inductance and capacitance is near about zero.

Inductance compensation can be for the system 100. In one example, the probe feed wire 130 produces its own impedance—additional to impedance of the patch antenna element 110 caused from inductance. The configuration of the patch antenna element 110 and the parasitic feed pad 120 together can be such that a capacitance is produced to negate the inductance of the patch antenna element 110 and the probe feed wire 130 (and other impedance of the system 100).

The system 100 can be configured such that the probe feed wire 130 does not touch the patch antenna element 110. In one example, the probe feed wire 130 terminates at the parasitic feed pad 120. In another example, the probe feed wire 130 passes through the parasitic feed pad 120 and terminates beyond the parasitic feed pad 120. With this, the patch antenna element 110 can have an opening through which the probe feed wire 130 passes. The parasitic feed pad 120 can be, in one embodiment, an orthogonal circular flat pad to the patch antenna element 110.

The probe feed wire 130 can emit an electromagnetic field and this electromagnetic field can excite the patch antenna element 110 (e.g., the probe feed wire 130 can parasitically feed the patch antenna element 110). The excitement can cause the patch antenna element 110 to be operational (e.g., function with a current produced from the electromagnetic field). Being operational can include allowing the system 100, which functions as an antenna, such as to communicate with another antenna.

To emit the electromagnetic field, the probe feed wire 130 can be supplied with a current. This supply can come from a coaxial cable and the probe feed wire 130, on an end opposite from the end approaching the patch antenna element 110, can have a connector to connect with the coaxial cable that supplies current from a current source. If the impedance is not compensated, then an impedance mismatch occurs between the current source and the system 100. Keeping the impedance mismatch results in increased return loss and a lower percentage of power radiated by the system 100 by way of the patch antenna element 110.

While FIG. 1*b* illustrates the patch antenna element 110 as being a square, various other shapes can be used. In one example, a desired polarization type can influence the shape of the patch antenna element 110. For linear polarization, the patch antenna element 110 can be, for example, square, rectangular, or a circle. For circular polarization, the patch antenna element can be, for example, a hexagon. In another example, multiple layers can be used (e.g., multiple layers of the parasitic feed pad 120).

Figure 2:
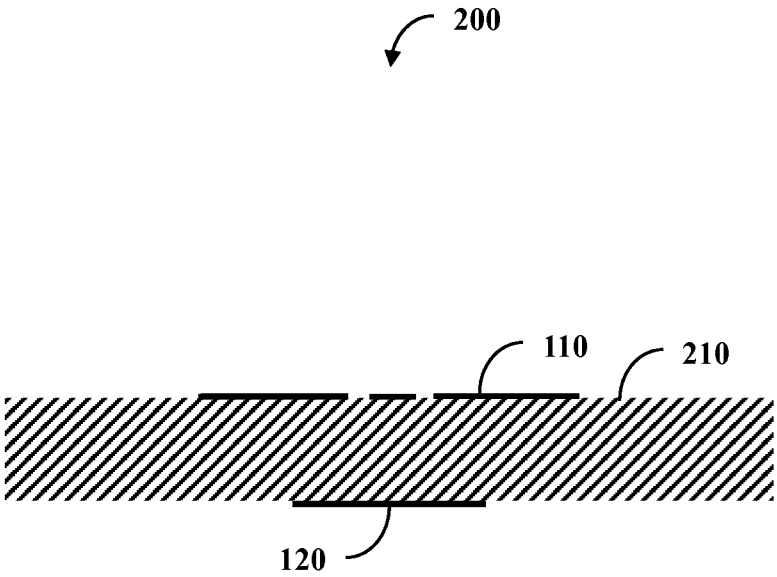
FIG. 2 illustrates one embodiment of a system comprising the patch antenna element, the parasitic feed pad, and a substrate material.

FIG. 2 illustrates one embodiment of a system 200 comprising the patch antenna element 110, the parasitic feed pad 120, and a substrate material 210. While air can separate the patch antenna element 110 from the parasitic feed antenna 120, these can also be separated by the substrate material 210. In one example, the patch antenna element 110 can be coupled to a first side of the substrate material 210. Likewise, the parasitic feed pad 120 can be coupled to a second side of the substrate material 210 that is opposite the first side of the substrate material.

In one embodiment, the substrate material 210 is used to secure the probe feed wire 130 of FIG. 1 (collectively FIGS. 1*a* and 1*b*). The parasitic feed pad 120 can have a hole. The probe feed wire 130 of FIG. 1 can pass through the hold and attach to the substrate material 210. Attachment can occur at the end of the probe feed wire 130 or elsewhere on the probe feed wire 130 of FIG. 1. The patch antenna element 130 can have a physical separation and the probe feed wire 130 can pass through the physical separation as well as the parasitic feed pad 120 while being attached to the substrate material 210 or elsewhere that is not the patch antenna element (e.g., when the substrate material is not used).

The substrate material 210 can be a printed circuit board material with copper on each side of the board and an object of a certain thickness in between both layers of copper. The patch antenna element 110 can be etched or milled onto one side of the copper board and likewise the parasitic feed pad can 120 be on the opposite side of the board. The thickness of the board is selected such that it creates the desired separation distance between the patch antenna element 110 and the parasitic feed pad 120. Substrate material thickness has great influence on the capacitance introduced to the system 200 as well as the ability for the parasitic feed pad 120 to couple energy onto the patch antenna element 110 (e.g., radiating patch element). The substrate thickness can be tightly controlled since the manufacturing tolerance of commercial printed circuit boards is typically extremely reliable. Once both sides of the printed circuit board are etched or milled, the probe wire feed 130 of FIG. 1 can be solder connected with the parasitic feed pad 120 or otherwise fixed. Connection can occur such that the probe feed wire 130 of FIG. 1 is orthogonal to the parasitic feed pad 120 and the patch antenna element 110 is parallel to the ground plane 140 of FIG. 1.

Figure 3:
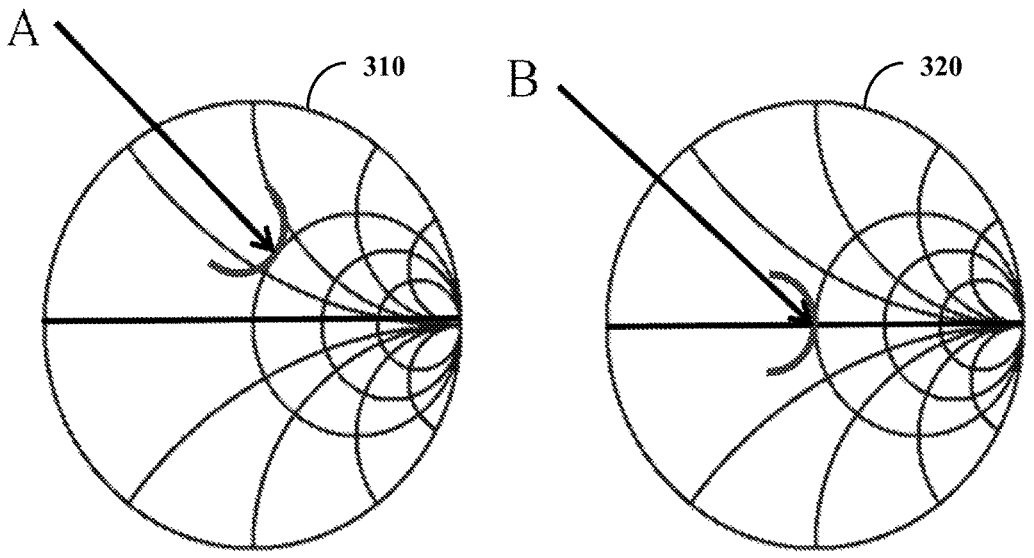
FIG. 3 illustrates one embodiment of a pair of Smith charts.

FIG. 3 illustrates one embodiment of a pair of Smith charts 310 and 320. The Smith chart 310 can illustrate an impedance curve sample without introduction of the parasitic feed pad 120 of FIG. 1. The Smith chart 320 can illustrate an impedance curve sample with introduction of the parasitic feed pad 120 of FIG. 1 and in turn introduction of the capacitor. To put another way, the Smith chart 320 can illustrate operation of the system 100 of FIG. 1. The Smith charts 310-320 shows with the curve at position A that the system 100 of FIG. 1 minus the parasitic feed pad 120 can include a real portion (resistance) and an imaginary portion (net inductance or capacitance). By introduction of the capacitor the curve can move to position B such that the imaginary portion is reduced to about zero.

Figure 4:
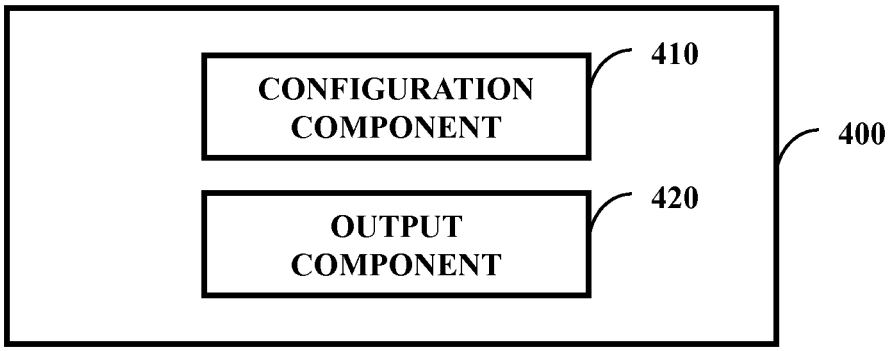
FIG. 4 illustrates one embodiment of a system comprising a configuration component and an output component.

FIG. 4 illustrates one embodiment of a system 400 comprising a configuration component 410 and an output component 420. The configuration component 410 can be configured to determine a parameter set for a patch antenna (e.g., the system 100 of FIG. 1) and the output component 420 can be configured to cause an output of the parameter set. The patch antenna can comprises the patch antenna element 110 of FIG. 1, the parasitic feed wire 130 of FIG. 1, and the parasitic feed pad 120 of FIG. 1. The patch antenna element 110 and the probe feed wire 130, both of FIG. 1, can produce an impedance (independently produce an impedance) and not touch one another. The patch antenna element 110 and the parasitic feed pad 120, both of FIG. 1, can be parallel to one another, stacked together, not touch, and together produce a capacitance in series with the impedance such that a sum of the impedance with the capacitance is equal to about zero.

In one embodiment the patch antenna comprises the substrate material 210 of FIG. 2. The substrate material 210 of FIG. 2 can separate the patch antenna element 110 of FIG. 1 from the parasitic feed pad 120 of FIG. 1. The parameter set can comprise a thickness of the substrate material 210 if FIG. 2. Another example of a parameter of the parameter set can be a shape of the patch antenna element 110 of FIG. 1 that influences a polarization type of the patch antenna.

Additionally, the parameter set can have information regard the parasitic feed pad 120 of FIG. 1. With this, the configuration component 410 can receive an operating frequency of the antenna (e.g., the system 100 of FIG. 1) and an impedance of the system 100 of FIG. 1. This can be used to determine a radius of the parasitic feed pad 120 of FIG. 1 and a distance between the parasitic feed pad 120 and the patch antenna element 110, both of FIG. 1, so that the impedance is compensated without excess capacitance.

The system 400 (e.g., patch antenna production system) can receive an input, such as by way of an interface. The input can be from a user and detail information on the patch antenna. Examples of the input can be size of the patent antenna element 110 of FIG. 1, length of the probe feed wire 130 of FIG. 1, and/or an operational frequency of the patch antenna, Based on this information, the parameter set for the patch antenna can be determined by the configuration component. In one example, the input can be analyzed (e.g. entered into an algorithm) and based on this analysis the parameter set can be determined. With this, the expected impedance of the patch antenna can be calculated and based on this the thickness of the substrate material 210 of FIG. 2 (and in turn distance between the patch antenna element 110 and the parasitic feed pad 120 both of FIG. 1) and/or the makeup (e.g., size and/or shape) of the parasitic feed pad 120 of FIG. 2 can be calculated. This calculation can be such that the impedance is compensated.

Figure 5:
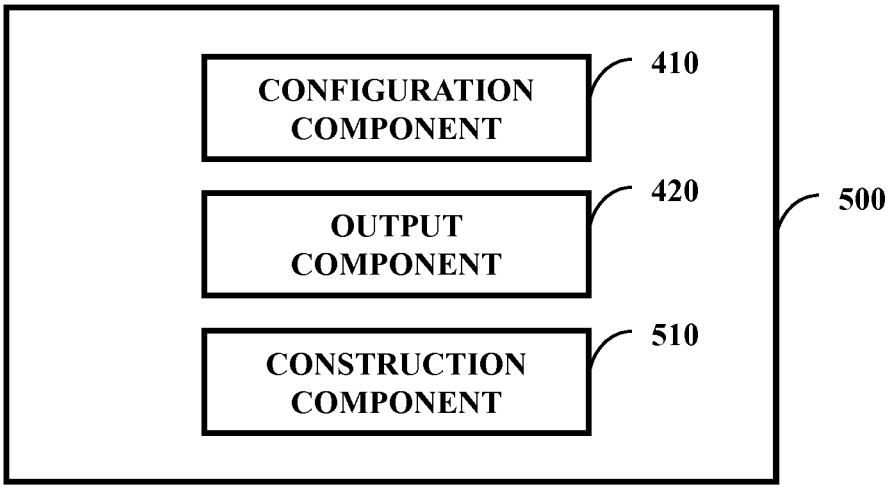
FIG. 5 illustrates one embodiment of a system comprising the configuration component, the output component, and a construction component.

FIG. 5 illustrates one embodiment of a system 500 comprising the configuration component 410, the output component 420, and a construction component 510. The construction component 510 can be configured to access the parameter set from the output and construct the patch antenna in accordance with the parameter set. Examples of construction can be cutting the substrate material 210 of FIG. 2, selecting the substrate material 210 of FIG. 2, affixing the patch antenna element 110 and the parasitic feed pad 120 both of FIG. 1 to the substrate material 210 of FIG. 2, and placing and affixing the probe feed wire 130 of FIG. 1.

Since exact compensation for impedance may be difficult to achieve, the construction component 510 can make modifications as appropriate. In one example, the parameter set can call for the substrate material 210 to be of x thickness, but available substrate materials may not include one of x thickness. Therefore, the construction component 510 can substitute for a substrate material closest to x thickness. However, distance between the patch antenna element 110 and the parasitic feed pad 120, both of FIG. 1, can be very small with a very low tolerance for variation and therefore the construction component 510 can decide to take alternative action (e.g., modify available substrate pieces).

The construction component 510 can function outside of the system 500. In one example, the system 400 of FIG. 4 transmits, by way of the output component 420 of FIG. 4, the parameter set to construction component 510. Based on this, the construction component 510 can produce a plurality of patch antenna in view of the parameter set (e.g., create a production line). In one embodiment, the construction component 510 builds the patch antennas while calculations on how the antennas should be built in view of the parameter set is produced elsewhere (e.g., by a calculation component that is part of the configuration component 410 and results are part of the parameter set). With this, the parameter set can be operational parameters (e.g., impedance is at y value) or functional parameters (e.g., the distance between the patch antenna element 110 of FIG. 1 and the parasitic feed pad 120 of FIG. 1 should by z centimeters).

Figure 6:
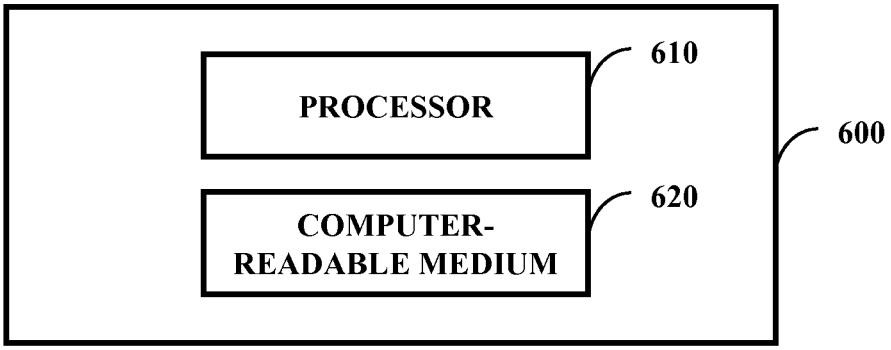
FIG. 6 illustrates one embodiment of a system comprising a processor and a computer-readable medium.

FIG. 6 illustrates one embodiment of a system 600 comprising a processor 610 (e.g., a general purpose processor or a processor specifically designed for performing functionality disclosed herein) and a computer-readable medium 620 (e.g., non-transitory computer-readable medium). In one embodiment, the computer-readable medium 620 is communicatively coupled to the processor 610 and stores a command set executable by the processor 610 to facilitate operation of at least one component disclosed herein (e.g., the configuration component 410 of FIG. 4). In one embodiment, at least one component disclosed herein (e.g., the output component 420 of FIG. 4) can be implemented, at least in part, by way of non-software, such as implemented as hardware by way of the system 600. In one embodiment, the computer-readable medium 620 is configured to store processor-executable instructions that when executed by the processor 610 cause the processor 610 to perform a method disclosed herein (e.g., the methods 700-1000 addressed below).

Figure 7:
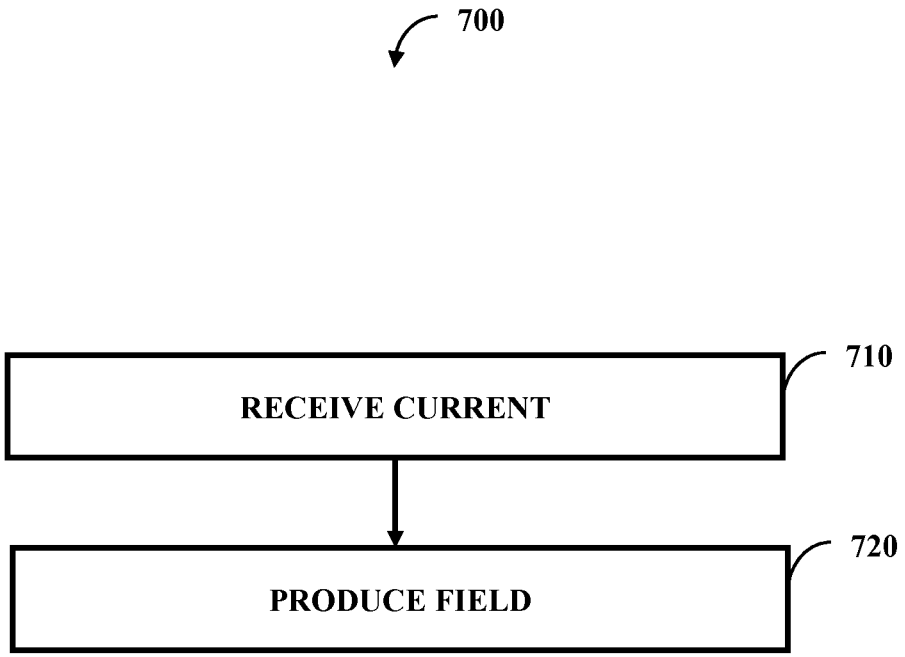
FIG. 7 illustrates one embodiment of a method comprising two actions.

FIG. 7 illustrates one embodiment of a method 700 comprising two actions 710-720. The method 700 can be for operation of, and performed by, the probe feed wire 130 of FIG. 1. At 710 a current can be received. In one embodiment, the probe feed wire 130 of FIG. 1 comprises a connector that is configured to connect with a coaxial cable. The coaxial cable supplies the current to the probe feed wire 130 of FIG. 1 that the probe feed wire 130 of FIG. 1 receives. At 720 the received current can be used to produce the electromagnetic field.

Figure 8:
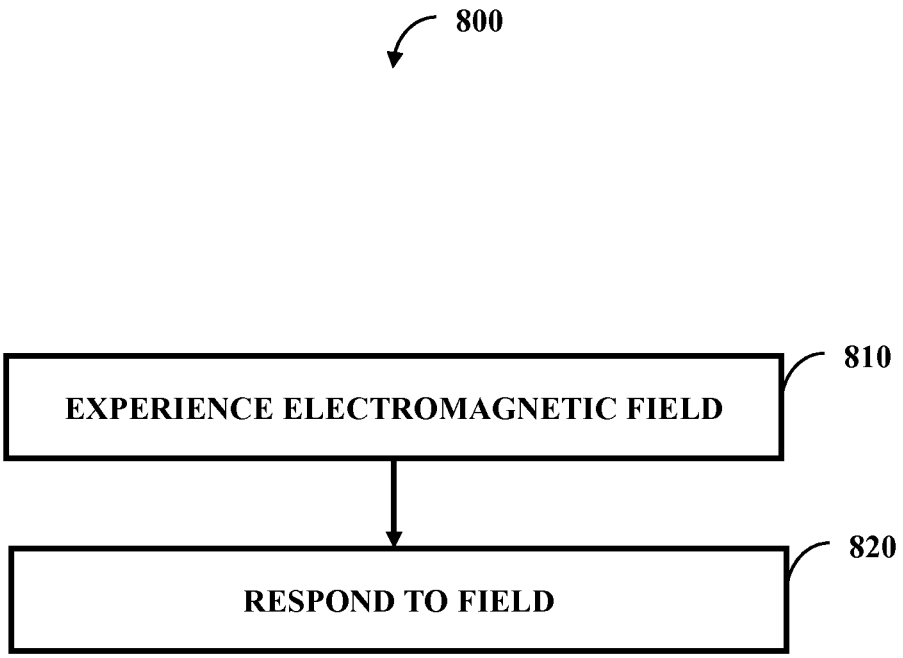
FIG. 8 illustrates one embodiment of a method comprising two actions.

FIG. 8 illustrates one embodiment of a method 800 comprising two actions 810-820. The method 800 can be for operation of, and performed by, the patch antenna element 110 of FIG. 1. At 810 an electromagnetic field can be experienced, such as the one produced by way of 720 of FIG. 7. Based on this the experience, at 820 a response to the electromagnetic field can occur. This response can cause the patch antenna element 110 of FIG. 1 to be operational.

Figure 9:
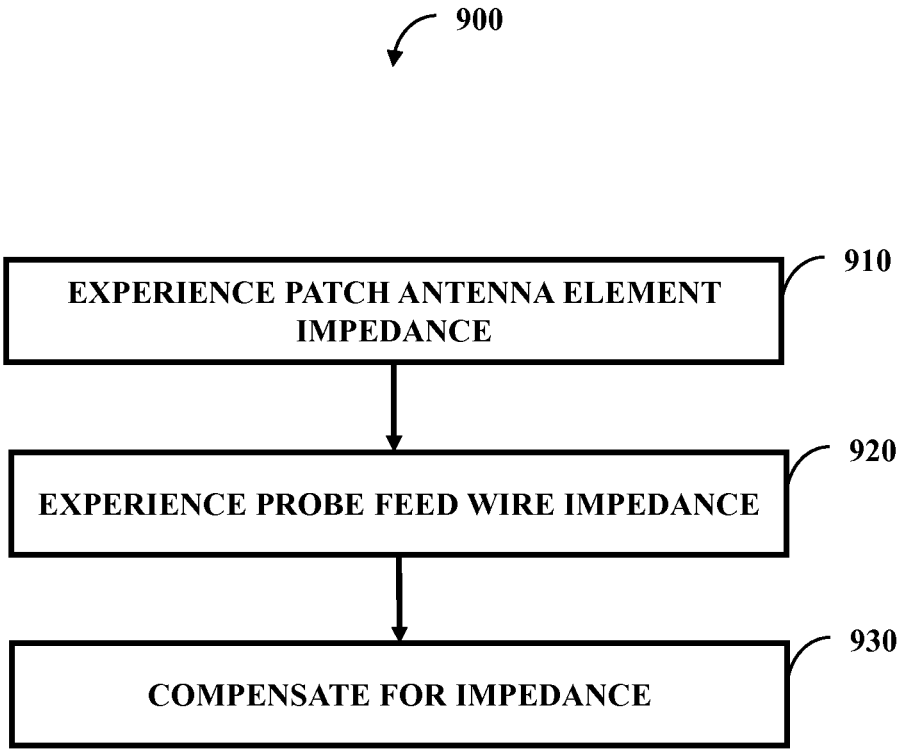
FIG. 9 illustrates one embodiment of a method comprising three actions.

FIG. 9 illustrates one embodiment of a method 900 comprising three actions 910-930. The method 900 can be for operation of, and performed by, the system 100 of FIG. 1. At 910 impedance from the patch antenna element 110 of FIG. 1 can be experienced while at 920 impedance from the probe feed wire 130 of FIG. 1 can be experienced. At 930, compensation can occur for at least part of the impedance. This compensation can be performed by a capacitor formed by the antenna element 110 and parasitic feed pad 120, both of FIG. 1.

Figure 10:
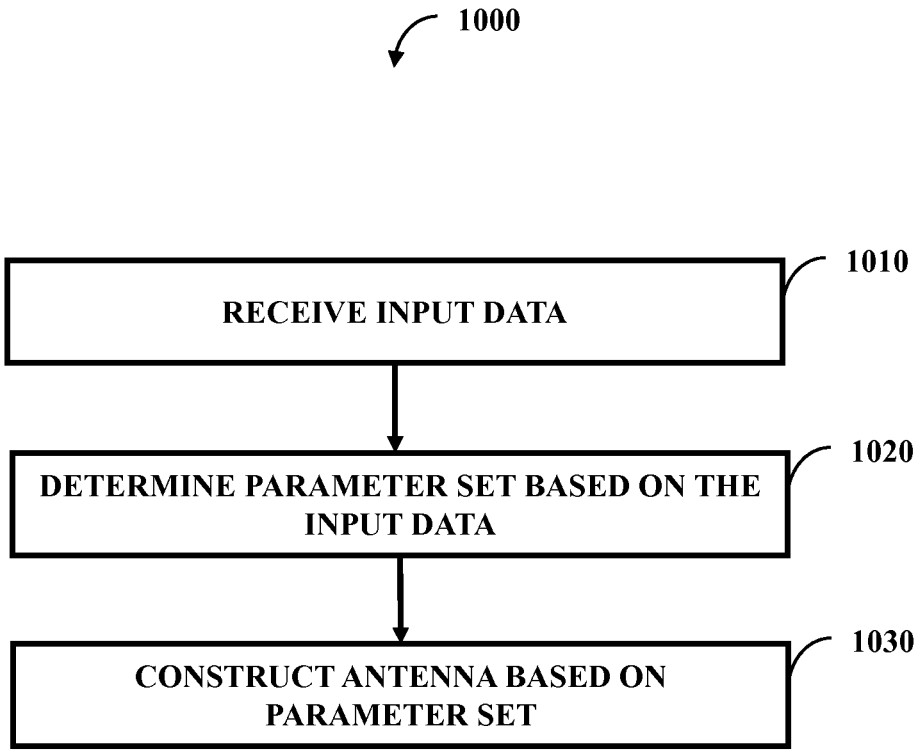
FIG. 10 illustrates one embodiment of a method comprising three actions.

FIG. 10 illustrates one embodiment of a method 1000 comprising three actions 1010-1030. The method 1000 can be for operation of, and performed by, the system 500 of FIG. 5. At 1010 input data can be received, such as desired performance for an antenna. Based on this input data a parameter set for the antenna can be determined at 1020. Based on this parameter set, at 1030 the antenna can be constructed.

While the methods disclosed herein are shown and described as a series of blocks, it is to be appreciated by one of ordinary skill in the art that the methods are not restricted by the order of the blocks, as some blocks can take place in different orders. Similarly, a block can operate concurrently with at least one other block.

Aspects disclosed herein can be used, for example, in the fields of electromagnetics, radio frequency engineering, and antenna design. Multiple benefits exist for practicing aspects disclosed herein. One benefit is that aspects provide an ability to match the impedance of the system 100 of FIG. 1 by adding a series capacitance, thus vastly reducing the negative impacts of the inductance introduced. Another benefit is that the series capacitance introduced to the system is done so without adding an additional component of a capacitor element, which eliminates further cost and system fabrication.

What is claimed is:

1. A system comprising: a patch antenna element; a probe feed wire that emits an electromagnetic field, where the patch antenna element and the parasitic feed pad are parallel to one another, where the patch antenna element and the parasitic feed pad do not touch, where the probe feed wire does not touch the patch antenna element, where the electromagnetic field excites the patch antenna element such that the patch antenna element is operational, where the patch antenna element produces a first impedance, where the probe feed wire produces a second impedance, and where a capacitance compensates for the first impedance and the second impedance.

2. The system of claim 1, where the probe feed wire terminates at the parasitic feed pad.

3. The system of claim 1, where the probe feed wire passes through the parasitic feed pad and terminates beyond the parasitic feed pad.

4. The system of claim 3, where the patch antenna element is of such a shape as to cause circular polarization when operational.

5. The system of claim 3, where the patch antenna element is of such a shape as to cause linear polarization when operational.

6. The system of claim 1, where the parasitic feed patch and patch antenna element are configured such that the first impedance and the second impedance are negated by the capacitance while excess capacitance that goes beyond negating the impedance of the system is equal to about zero.

7. A system, comprising:

a patch antenna element;

a parasitic feed pad; and a probe feed wire that emits an electromagnetic field to excite the patch antenna element such that the patch antenna element is operational, where the probe feed wire does not touch the patch antenna element, where the patch antenna element and the parasitic feed pad are parallel to one another, where the patch antenna element and the parasitic feed pad are stacked together, where the patch antenna element and the parasitic feed pad do not touch, where the patch antenna element and the probe feed wire together produces an impedance, where the patch antenna element and the parasitic feed pad together produce a capacitance such that a sum of the impedance with the capacitance is equal to about zero, and where the capacitance is in series with the impedance.

8. The system of claim 7, comprising:

a substrate material, where the patch antenna element is coupled to a first side of the substrate material and where the parasitic feed pad is coupled to a second side of the substrate material that is opposite the first side of the substrate material.

9. The system of claim 8, where the patch antenna element has a physical separation, where the probe feed wire passes through the physical separation, and where the probe feed wire passes through the parasitic feed pad.

10. The system of claim 7, where the probe feed wire terminates at the parasitic feed pad.

11. The system of claim 7, where the probe feed wire passes through the parasitic feed pad and terminates beyond the parasitic feed pad.

12. A patch antenna production system, that is at least in part hardware, comprising:

a configuration component configured to determine a parameter set for a patch antenna; and an output component configured to cause an output of the parameter set, where the patch antenna comprises a patch antenna element, a parasitic feed wire, and a parasitic feed pad, where the probe feed wire does not touch the patch antenna element, where the patch antenna element and the parasitic feed pad are parallel to one another, where the patch antenna element and the parasitic feed pad are stacked together, where the patch antenna element and the parasitic feed pad do not touch, where the patch antenna element and the probe feed wire together produces an impedance, where the patch antenna element and the parasitic feed pad together produce a capacitance such that a sum of the impedance with the capacitance is equal to about zero, and where the capacitance is in series with the impedance.

13. The patch antenna production system of claim 12, comprising:

an identification component configured to identify the impedance;

a capacitance calculation component configured to calculate the capacitance that offsets the impedance such that the sum is equal to about zero;

a distance component configured to determine a desired distance between the patch antenna element and the parasitic feed pad, a selection component configured to select a thickness of a substrate material that separates the patch antenna element from the parasitic feed pad at the desired distance; and where the parameter set comprises the thickness of the substrate material, where the distance component determines the desired distance by determination of a distance that causes the patch antenna to have the capacitance that offsets the impedance.

14. The patch antenna production system of claim 12, where the parameter set is determined, at least in part, by an operational frequency of the patch antenna.

15. The patch antenna production system of claim 12, comprising:

a construction component configured to:

access the parameter set from the output and construct the patch antenna in accordance with the parameter set.

16. The patch antenna production system of claim 15, comprising:

an identification component configured to identify a desired polarization type of the patch antenna, a selection component configured to select a shape of the patch antenna element to achieve the desired polarization type of the patch antenna, where the selected shape of the patch antenna is pan of the parameter set such that the construction component is configured to construct the patch antenna element with the selected shape.

17. The patch antenna production system of claim 12, comprising:

an identification component configured to identify a desired polarization of the patch antenna;

a selection component configured to select a shape for the patch antenna element to produce the desired polarization, the selected shape being part of the parameter set.

18. The patch antenna production system of claim 12, comprising:

a construction component configured to:

access the parameter set from the output and construct the patch antenna in accordance with the parameter set such that the patch antenna is formed of the selected shape.

19. The system of claim 1, where the patch antenna element and the parasitic feed pad are at a fixed distance from one another, where patch antenna element and the parasitic feed pad being a fixed distance from one another cause the first impedance to be fixed, and where the probe feed wire, when consistently excited, produces the second impedance to be fixed.

20. The system of claim 7, where the patch antenna element is a singular patch antenna element, where the probe feed wire is a singular probe feed wire.

* * * * *